United States Patent [19]

Martinou et al.

[11] Patent Number: 4,886,583

[45] Date of Patent: Dec. 12, 1989

[54] FORMATION OF PROTECTIVE COATINGS BY ELECTROLYTIC CODEPOSITION OF A NICKEL-COBALT MATRIX AND CERAMIC PARTICLES

[75] Inventors: Robert L. Martinou, Bry sur Marne; Michel M. Ruimi, Paris, both of France

[73] Assignee: Societe Nationale d'Etude et de Construction de Moteurs d'Aviation "S.N.E.C.M.A.", Paris, France

[21] Appl. No.: 213,910

[22] Filed: Jun. 30, 1988

[30] Foreign Application Priority Data

Jul. 1, 1987 [FR] France ..... 87 09289

[51] Int. Cl.[4] ..... C25D 15/00

[52] U.S. Cl. ..... 204/16

[58] Field of Search ..... 204/16, 37.1, 41

[56] References Cited

U.S. PATENT DOCUMENTS 3,152,971 10/1964 Tomaszewski ..... 204/41
4,305,792 12/1981 Kedward ..... 204/16

FOREIGN PATENT DOCUMENTS 1533441 4/1971 Fed. Rep. of Germany .
2412626 12/1988 France .

OTHER PUBLICATIONS

U.S. Pat. No. 3,152,971, (Tomaszewski), Colonne 2, Lignes 5-8; Colonne 4, Lignes 55-60.
U.S. Pat. No. 4,613,388, (Walter).

*Primary Examiner*—T. M. Tufariello
*Attorney, Agent, or Firm*—Oblon, Spivak, McClelland, Maier & Neustadt

[57] ABSTRACT

Alloy steel or nickel based superalloy parts may be given protection against oxidation and frictional wear at temperatures below 600° C. by means of a protective coating applied by electrolyte codeposition of a nickel-cobalt matrix comprising a uniform dispersion of ceramic particles selected from a group of carbides and oxides including SiC, $Al_2O_3$, and $Cr_2O_3$, the mass content of the ceramic particles being between 3.5% and 10%. The deposition is carried out in a sulfamate bath comprising a metallic salts content (Ni+Co) of from 70 g/l to 100 g/l, a Ni/Co mass ratio of from 5 to 33, and a mass content of the ceramic particles in suspension of from 50 g/l to 300 g/l.

18 Claims, 6 Drawing Sheets

NICKEL-COBALT + SiC

NICKEL-COBALT + $Cr_2O_3$

NICKEL-COBALT + $Al_2O_3$

• INITIAL STATE

• 100h - 500°C

• 100h - 450°C

• 100h - 550°C

• 2h-600°C

• 75h-600°C

• 25h-600°C

• 100h-600°C

FORMATION OF PROTECTIVE COATINGS BY ELECTROLYTIC CODEPOSITION OF A NICKEL-COBALT MATRIX AND CERAMIC PARTICLES

BACKGROUND OF THE INVENTION

1. Field of the Invention

The invention relates to the protection of articles made of alloy steel or a nickel-based superalloy against oxidation and frictional wear at temperatures up to 600° C.

2. Summary of the Prior Art

Assemblies of components in turbo-machines frequently operate without conventional lubrication by oil circulation or greasing. Such assemblies, for example the mountings of compressor blades in the disc sockets, the main shaft splines, the passages for the disc tie-rods, the suspension axles, the joints, or even the shock absorbers of the high pressure (HP) compressor disc, are all places where there is local contact between parts which often entail slight movements and wear due to microclearances (rubbing). Furthermore, there are a number of cases of wear brought on by major relative movement. These phenomena can give rise to fatigue cracks and lead to premature breakage of parts.

Furthermore, one particular and just as troublesome kind of wear is observed in the compressor flow paths, i.e. wear by erosion.

All the types of wear and tear mentioned bring about deterioration of the surfaces and/or changes in the dimensions of the blade assemblies at the tips, at the leading edges, and at the trailing edges, the practical consequences being a reduction in the effective life of the blades and substantial losses in HP compressor performance. This sensitivity is bound up with the materials used for the blades, especially the moving parts.

For instance, studies carried out on HP compressors in operation have revealed that after 3000 flight cycles of 3 hours and 30 minutes, considerable losses of efficiency amounting to as much as 14% flow loss were due to the factors mentioned above, particularly blade erosion and blade tip wear.

Remedies to the problems of dry wear due to microclearances may be found by employing solid materials such as steels with a high carbon content, for example Z100 CD 17 (AFNOR standard—steel containing 1% C, 17% Cr and 0.5% Mo) with a high hardness level when cold, or forged cobalt-based alloys, cast or obtained by fusion. Coatings applied by plasma, such as tungsten carbides containing 17% cobalt, chromium carbides, and cobalt-based alloys can be used, but are applicable only in an homogeneous pairing in order to obtain sufficiently low friction coefficients.

The recourse to electrolytic coatings containing cobalt and about 30% chromium carbide indicated in French specification No. A-2 412 626 makes it possible to improve dry friction behaviour within a temperature range of between 300° and 750° C.

However, the processes mentioned above do not make it possible to resolve simultaneously the problems of wear due to microclearances and erosion.

The production of coatings using electrolysis is desirable in many cases, for example:

when the geometry of the parts to be treated is complex, plasma application of coatings may be difficult if not impossible (for instance in the case of small diameter bores);

whenever it is desired to apply thin, fairly homogeneous deposits;

when replacing certain sprayed coatings which, applied to parts which suffer from friction, might lead to deformation due to heating caused by the spraying process; and, according to the type of parts involved, electrolytic coatings may be cheaper than plasma coatings and therefore offer a better efficiency/cost compromise.

The invention seeks to provide an electrolytic process which permits the codeposition of nickel and cobalt with ceramic particles to yield a hard composite material with a good level of resistance to wear and erosion.

U.S. patent specification No. 3 152 971 mentions the possibility of forming a codeposit of electrolytic nickel with powders of the ceramic type in order to produce an anti-reflective satinised finish coating, but this is an entirely different purpose from that with which the present invention is concerned. Furthermore, this document does not disclose the use of any nickel-cobalt-ceramic combination, nor does it show any means of optimising an homogeneous ceramic particle concentration in the coating or surfacing formed.

The difficulty with obtaining a nickel-cobalt codeposit is that for two or more species to be discharged simultaneously onto the cathode during electrolysis, the species must be in ionic forms such that they have closely aligned discharge potentials during deposition, which is not the case with nickel and cobalt. Obtaining a Ni-Co-ceramic electrolytic alloy thus requires:

reconciling the equilibrium voltages of the metals present in solution, increasing the excess voltage of the most positive metal, and reducing the excess voltage of the most negative metal.

One of the objects of the invention, therefore, is to find a compromise between the electrolysis conditions in order to bring about an effective electrolytic deposition of nickel and cobalt and to optimise the Ni/Co ratio during the process of electrolysis in order to obtain satisfactory dispersion of the ceramic particles in the final coating and also adequate homogeneity within the coating.

SUMMARY OF THE INVENTION

According to the invention, there is provided a method of protecting an alloyed steel or nickel- based superalloy substrate against oxidation and frictional wear at temperatures below 600° C., characterised in that the substrate is provided with a protective coating by electrolytic codeposition of a binary nickel-cobalt matrix including an homogeneous dispersion of ceramic particles selected from a group of oxides and carbides including SiC, $Al_2O_3$ and $Cr_2O_3$, the content of the ceramic particles in the coating being from 3.5% to 10% by mass, and the electrolytic codeposition being carried out in a sulphamate bath comprising a metallic salts content (Ni+Co) of from 70 g/l to 100 g/l, a Ni/Co mass ratio of from 5 to 33, and a mass content of the ceramic particles in suspension of from 50 g/l to 300 g/l.

Ni-Co-SiC on Ni-Co-SiC (at 400° C.)

Ni-Co-SiC on Z12 C13 (at 20° C., 250° C. and 400° C.)

Ni-Co-SiC on NC 20 K14 (at 20° C., 250° C. and 400° C.).

DESCRIPTION OF THE PREFERRED EMBODIMENTS

Figure 1:
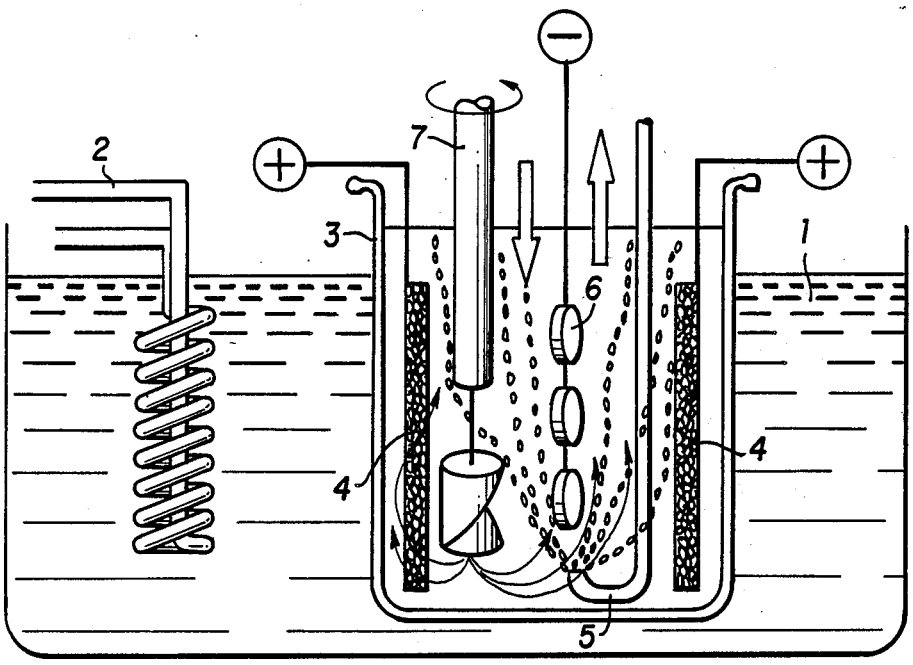
FIG. 1 is a diagram of an electrolysis tank which may be used in the method in accordance with the invention.
Figure 2:
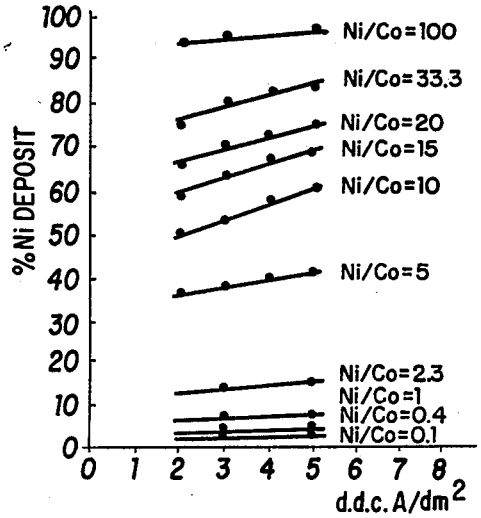
FIG. 2 is a graph showing the effect of the Ni/Co ratio and of the current density on the coating composition produced.
Figure 3:
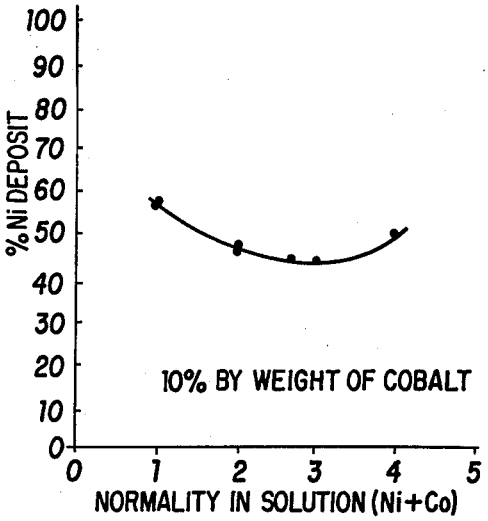
FIG. 3 is a graph showing the influence of the metallic salts (Ni+Co) concentration in the electrolysis bath on the coating composition.
Figure 4:
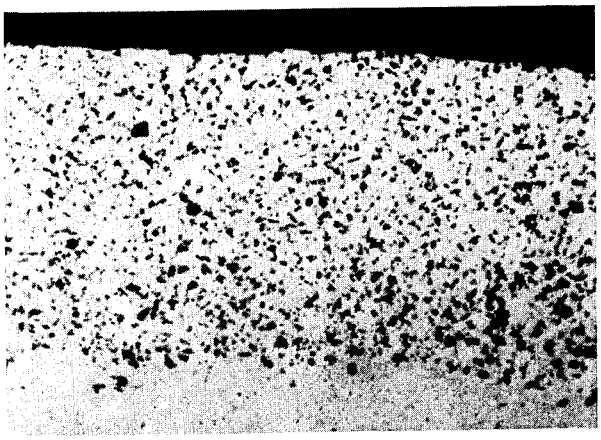
FIG. 4 is a micrograph (enlarged 1000 times) of a section through a nickel-cobalt+SiC coating obtained by a method in accordance with the invention.

Various experiments were carried out in a rectangular or cylindrical electrolysis tank 3 such as that shown in FIG. 1, the tank 3 being located in a vessel 1 filled with water heated by a heating resistor 2. The electrolysis tank 3 contains Ni and Co salts and ceramic particles in suspension in an electrolyte having a composition as stipulated hereinafter. Anodes 4 supplied by a current generator (not shown) are formed by nickel balls S disposed in titanium baskets.

A combination bath agitation system was contrived. Indeed, ordinary agitation methods proved not to be very efficient in maintaining the dispersion of the particles within the electrolyte and in obtaining in the final coating an acceptable and reproducible level of occlusion.

A combination of a number of suitable agitation methods made it possible to control the maintenance of fine ceramic particles in suspension in the electrolyte, thus ensuring their better incorporation into the metallic matrix. A particular installation was thus perfected which comprises a two-fold agitation of the electrolyte by compressed air supplied through an inlet pipe 5 and by a turbine disperser 7 which is rotated at high speed. Tests carried out with the disperser 7 rotated at speeds between 1750 and 2250 revolutions per minute demonstrated that a speed of rotation of 2000 rpm combined with agitation by the compressed air was preferred. In addition, the cathode carrying the parts 6 to be coated was installed on a mechanism for moving it "up and down" at a controlled speed, the travel varying according to the nature and size of the parts to be coated.

Before incorporating the ceramic particles into the electrolyte, the best electrolyte was found by testing various compositions, the choice falling to nickel-cobalt solutions in a sulphamate bath by virtue of the high performance coatings which they produce, both from the point of view of the mechanical characteristics and the stability of the alloy composition. Furthermore, in contrast to other currently used baths (containing chloride, acetate or pyrophosphate), the produce coatings having low internal stresses while accepting high deposition speeds.

The baths used comprised:

as primary constituents:

- nickel sulphamate as a source of Ni++ ions necessary for the nickel coating;
- cobalt sulphamate as a source of Co++ ions for simultaneous deposition together with the nickel;
- boric acid as a buffer agent for maintaining the pH constant within the bath and at the cathode-solution interface; and,
- nickel chloride (in a maximum concentration of 10 g/l), for although it is the cause of internal stresses, it does encourage anode corrosion and therefore increases the cathodic efficiency of the bath; or
- nickel bromide as an alternative to nickel chloride if the bath does not contain very much cobalt (1.5 g/l), it creating the risk of anodic passivation if the cobalt content in the bath is high;

and as secondary constituents (additives):

- wetting agents (surface-active agents and/or surfactants) which accelerate the release of hydrogen bubbles from the surface of the parts and make it possible to avoid surface pitting;
- levelling agents which reduce the presence of pronounced excrescences at high cathode current densities; and,
- internal stress-reducing agents.

Nine combinations were tested, corresponding to Ni/Co ratios of 5, 15 and 20, representing a content of cobalt in solution of around 16.6, 6.2 and 4.3%, and to contents by mass of metallic salt Ni+Co equal to 75 g/l (normal concentration 2.54 N), 87.5 g/l (concentration 2.96 N) and 100 g/l (concentration 3.40 N). These 9 sulphamate bath compositions are detailed in Table 1.

The electrolyte bath was made up in the following manner:

half the volume of deionised water needed was placed in the tank;

the volume of nickel sulphamate calculated on the basis of the concentrated solutions received was added;

the solution was heated to between 40° and 45° C. with continuous stirring;

the quantity of nickel chloride was added in small amounts, the solution being stirred until it had completely dissolved;

the boric acid was gradually added (it is recommended that the boric acid be dissolved in a solution of deionised water heated to 65° to 70° C. in order to accelerate this stage);

the amount of cobalt sulphamate required was added and the solution homogenised;

the solution was treated for three hours with activated charcoal to eliminate organic impurities;

the solution was filtered;

the pH was adjusted with a solution of sulphamic acid diluted to 10% by mass;

deionised water was added to make the solution up to the required volume; and the wetting agent (lauryl-sodium sulphate) was added.

The development of the cobalt element in the nickel-cobalt alloy formed could be followed over quite a range of current densities, having regard to variable parameters such as the Ni/Co ratio and the total concentration of metallic salts (Ni+Co).

Analyses carried out by plasma emission spectrometry (ICP) on samples given an electrolytic coating in the 9 baths C to K of Table 1 made it possible to choose four alloy compositions (23±3, 42±4, 64±2 and 72±2% cobalt) with a view to characterising them in structure, hardness and level of internal stress, and these latter tests resulted in choosing only those coatings which contained 29 and 42% cobalt corresponding to baths F and G. The coating with 29% Co was chosen for its low internal stresses (approx., 100 MPa), while that containing 42% Co was chosen for its high hardness (550 HV).

Characterisation tests showed that the alloy with 29% Co is slightly superior to the pure nickel and to the 42% alloy in the areas of wear resistance at 20° C. in heterogeneous pairings, and resistance to abrasion and erosion under small impact angles.

For these reasons, the preferred final surfacing or coating alloy for incorporating ceramic particles, was chosen as the binary nickel-cobalt matrix containing 29% cobalt.

In order to arrive at this final content of cobalt, bearing in mind the presence of ceramic particles M in the bath, the Ni/Co ratio was chosen to be equal to 15 and the total metallic salt content (Ni+Co) equal to 87.5 g/l (bath G in Table 1) to achieve the desired concentration of cobalt.

Having optimised the parameters for the Ni-Co co-deposition, the incorporation of three kinds of ceramic powders M was tested in the electrolyte baths. Thus, silicon carbide SiC, or $Cr_2O_3$ and alumina $Al_2O_3$ were used. In all three cases, the content by mass of the ceramic particles M in suspension in the electrolyte was chosen from the range of from 70 to 150 g/l.

Figure 5:
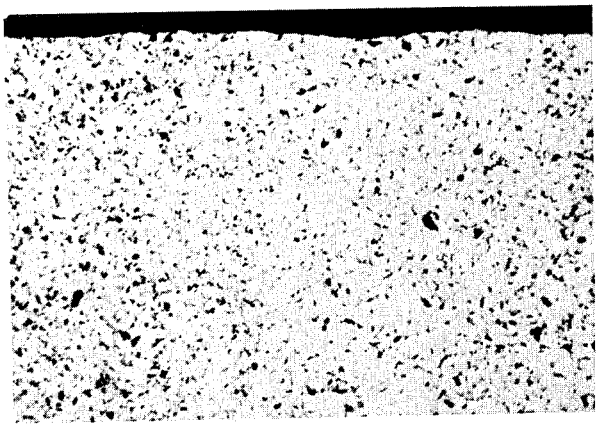
FIG. 5 is a view similar to FIG. 4, but of a nickel-cobalt+$Cr_2O_3$ coating.
Figure 5A:
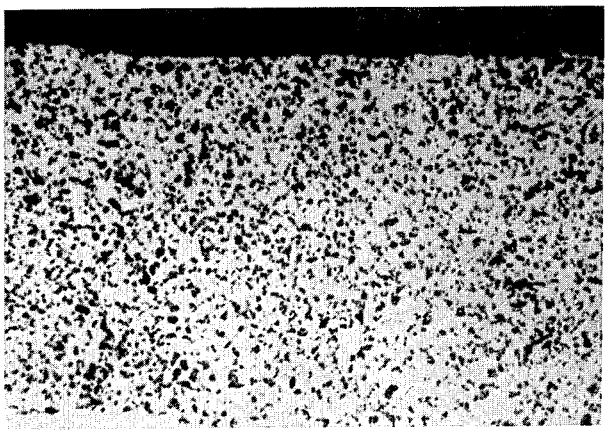
FIG. 5*a* is also a view similar to FIG. 4, but of a nickel-cobalt+$Al_2O_3$ coating.
Figure 6A:
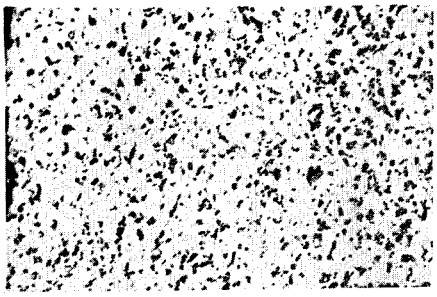
FIGS. 6*a* to 6*h* show micrographs (enlarged 1000 times) of the Ni-Co-SiC coating showing the effects of temperature and of the time the temperature is maintained on the morphology and oxidation of the coating.
Figure 6C:
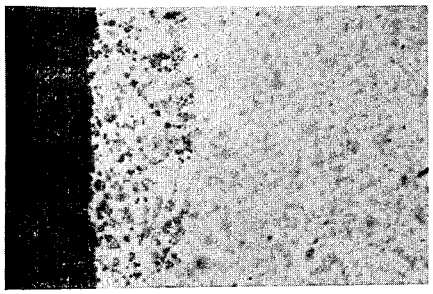
Figure 6B:
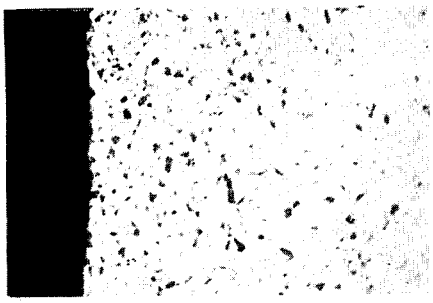
Figure 6D:
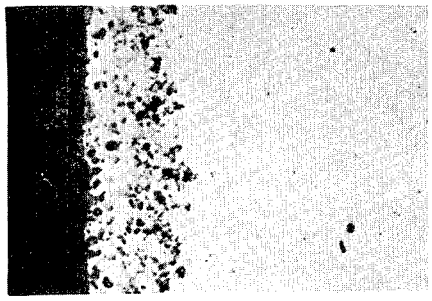
Figure 6E:
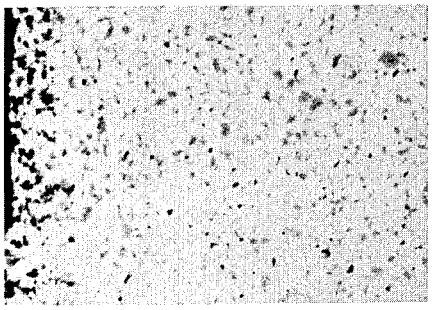
Figure 6G:
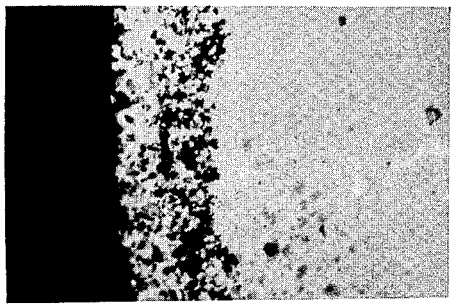
Figure 6F:
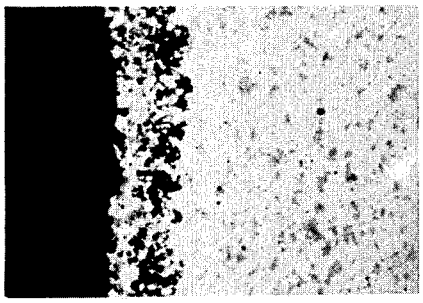
Figure 6H:
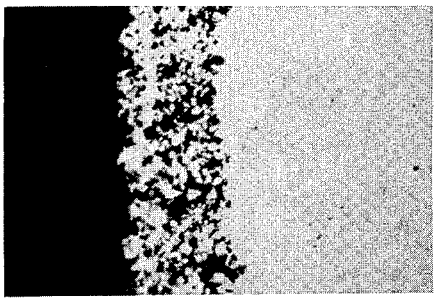
Figure 7A:
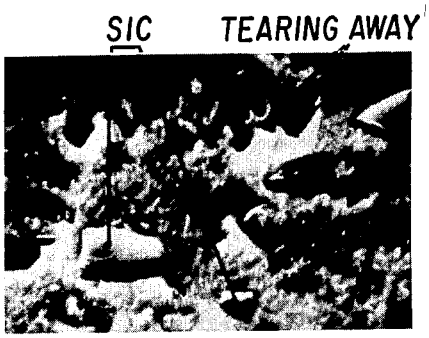
FIGS. 7*a* and 7*b* are micrographs (enlarged 5000 times) of the same Ni-Co-SiC coating in the raw condition and after being exposed to air for 100 hours at 600° C.
Figure 7B:
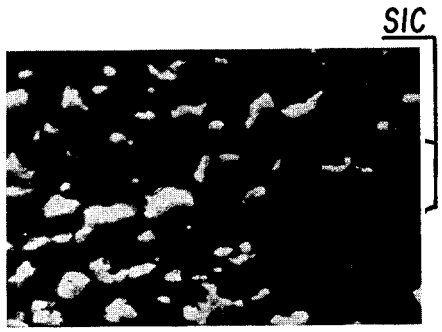

The many tests conducted showed that the homegeneity in the dispersion of the ceramic particles in the coating obtained was satisfactory with the powder M having a granulometry of between 1 and 5 micrometers, as is confirmed by the microphotographs of FIGS. 5 to 7.

It was likewise found that, prior to the addition of the ceramic particles to the electrolyte baths, and particularly with SiC and $Al_2O_3$, it is advisable to eliminate all trace of unwanted metallic impurities (for example iron). For this purpose the method of the invention preferably involves subjecting the ceramic powders to a decontamination operation entailing acid washing in a hydrochloric medium prior to their addition to the electrolyte.

The tests conducted with the three types of ceramics stated above were carried out with the following electrolysis parameters:

a current density (ddc) between 2.5 and 15 A/sq.dm.;

a temperature between 50° and 54° C.; and a pH between 3.5 and 4.5.

The determination of these parameters was dictated by the following factors:

The choice of a particular temperature is based on the fact that the primary reason for raising temperature is to increase the maximum admissible current density with a view to achieving high rates of electrochemical reactions and diffusion. However, problems are observed in connection with particle transport velocity, which may reduce the level of occlusion. Within a range of temperatures between 20° and 60° C., the level of incorporation of $Al_2O_3$ or SiC particles remains constant, while that of $Cr_2O_3$ increases with the temperature.

The current density is an important parameter which depends on the molar concentration of the electrolyte and the bath temperature. When a coating is being formed, the current density determines, amongst other things, its rate of deposition, its structure, and its distribution. With regard to composite coatings, the quantity of particles incorporated is directly in proportion to the current density applied. As a result, the total percentage of occluded particles diminishes as the current density increases and that is why it is preferable to work at a low current density (5 A/sq. dm) in order to increase the level of particles in the metallic matrix, the velocity of the metallic ions being greater than the rate of particle adsorption. This observation is verified particularly in the case of incorporation of $Al_2O_3$ particles and SiC particles.

More precisely, in the case of SiC, $Al_2O_3$ and $Cr_2O_3$ particles, the foregoing parameters were chosen to have the following values:

| | SiC | $Al_2O_3$ | $Cr_2O_3$ |
|---|---|---|---|
| ddc = | 5 A/sq. dm. | 5 A/sq. dm. | 3 A/sq. dm. |
| Temperature = | 52° ± 2° C. | 52° ± 2° C. | 52° ± 2° C. |
| pH = | 4 ± 0.2 | 4 ± 0.2 | 4 ± 0.2 |

and the coatings obtained had the following compositions by weight:
66 ± 2% Ni, 30 ± 2% Co, 4 ± 2% SiC.
63 ± 3% Ni, 32 ± 2% Co, 4,5 ± 0.5% $Al_2O_3$
58 ± 3% *Ni*, 33 ± 3% *Co*, 9 ± 1% $Cr_2O_3$ The coatings were deposited on two types of substrate, a high strength alloy steel Z 85 W CD V6 (AFNOR standard—steel containing 0.85% C+6% W+5% Cr+4% Mo+2% Va) and two nickel-based superalloys NC 10 FeNb (AFNOR standard—nickel-based alloy comprising 19% Cr+18% Fe+5% Nb) and NC 22 FeD (AFNOR standard—nickel-based alloy comprising 22% Cr+19% Fe+9% Mo).

These substrates are significantly of iron-based and nickel-based alloys because the coatings in accordance with the invention exhibit good adherence to these alloys, and therefore all iron-based or nickel-based substrates may be covered with the protective coatings in accordance with the invention.

The substrates should undergo a surface preparation before being subjected to the electrolytic coating. The surface preparation operations comprising scouring and surface activation are conventional. A prenickelling bath containing a more or less high content of hydrochloric acid is preferably used to ensure maximum adhesion before applying the nickel-cobalt-ceramic coating to the said substrates.

The part is then best able to receive the nickel-cobalt-ceramic deposit indicated above.

After formation of the coating as described, an electrolytic chromium-plating may be carried out to a plating thickness of, for example, from 2 to 10 micrometers, in order to increase the resistance to oxidation of the nickel-cobalt-ceramic coating under heat.

With regard to the particular case of a Ni-Co-SiC coating, consolidation of the particles in the matrix can be improved by a subsequent heat treatment to diffuse the silicon under an inert gas for a period ranging from 1 hour to 3 hours and at a temperature of from 550° C. to 620° C.

After deposition of the protective coating, examinations of the structure were carried out on examples with a Ni-Co-SiC coating. The examinations were conducted in the raw state immediately after coating, and after periods of exposure to temperatures ranging from 400° to 600° C. for 2 to 100 hours. The following methods were used:

optical microscopy in a polished state, not attacked;

scanning electron microscopy (MEB) after electrolytic polishing in a sulphuric/methane solution (1/7—0° C.—10 sec.); and energy dispersion analyses (ADE).

Figure 8A:
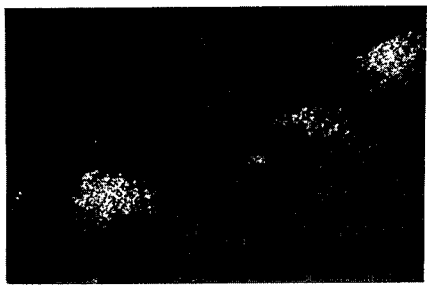
FIGS. 8*a*, 8*b*, 9*a*, 9*b*, 10, 10*b* are photographs showing X-ray images of silicon (FIG. 8), nickel (FIG. 9) and cobalt (FIG. 10) in the raw state (index a) and after 100 hours at 600° C. (index b) in a Ni-Co-SiC coating (enlarged 5000 times)
Figure 8B:
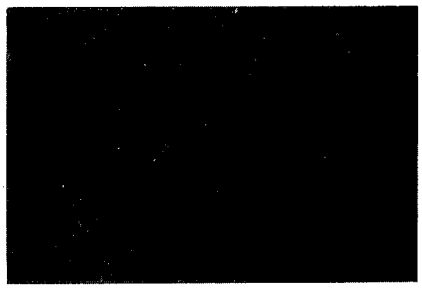
Figure 9A:
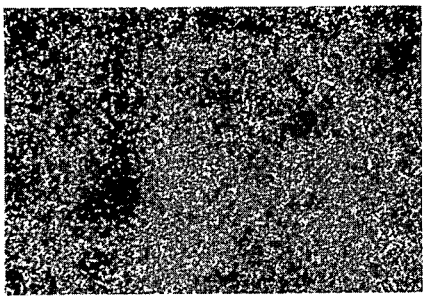
Figure 9B:
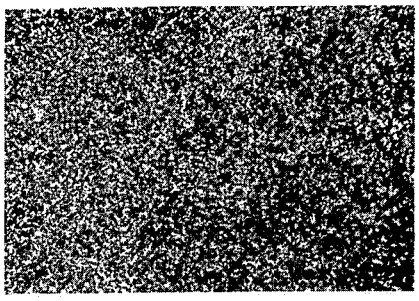
Figure 10A:
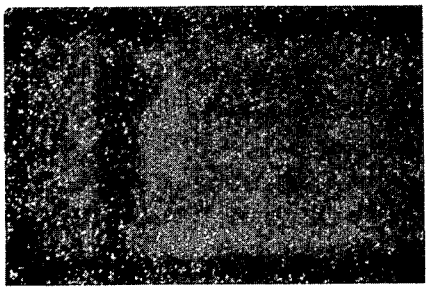
Figure 10B:
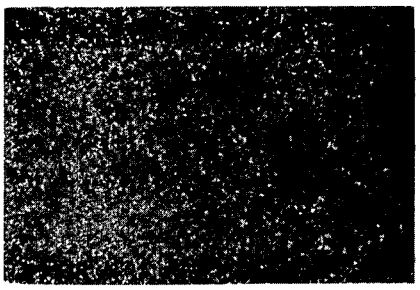

Upon completion of these examinations, the following main points with regard to the attached Tables and drawings were established:

in the raw state (FIGS. 6*a* to 6*h*), the SiC particles (in dark grey) are uniformly distributed throughout the coating. The MEB examinations demonstrate the close contact between these particles and the metallic nickel-cobalt matrix;

similarly, the 100 hour aged state at 600° C. also exhibits a particular characteristic. The micrographs (FIGS. 7*a* and 7*b*) reveal a change in colour of the SiC particles (from dark grey to light grey) corresponding to an impoverishment of silicon. Indeed, X-ray microanalysis reveals a silicon diffusion phenomenon from the particles in the metallic nickel-cobalt-matrix (FIGS. 8 to 10).

While the samples were being prepared, it was noted that the particle clung readily to the matrix.

To verify the possible presence of substrate-coating diffusions, relationships of compositions of the main chemical elements were established by means of X-ray microanalysis. Upon completion of these tests, only diffusions of the elements chromium and iron in the nickel-cobalt matrix could be observed at respective depths of 10 and 20 micrometers with respect to the substrate/coating interface.

Comparison of the different states aged for 100 hours at 450°, 500°, 550° and 600° C. made it possible to show the development of the behaviour of the coatings (FIGS. 6*b* to 6*h*). After 100 hours at 450° C., it was found that the change in colour (dark grey to light grey) was not complete. However, numerous particles did show two zones of different colours: a dark grey zone with a silicon content comparable with that obtained in the raw state and a low-silicon light grey zone. Therefore, after 100 hours at 450° C., diffusion of the silicon from the particles to the nickel-cobalt matrix is still incomplete.

FIGS. 6*a* to 6*h* likewise show that the oxidised depth of the surface is related to the time for which the temperature is maintained but that this layer is of a substantially constant thickness for 100 hours at 500°, 550°, and 600° C.

Abrasion wear tests were conducted using a TABER abrasimeter comprising two circular mills carrying a load and driven frictionally by the piece to be tested which is moved in a circular motion. The results of these tests are summarised in Table 2, and show that the Ni-Co-SiC coatings offer excellent resistance to wear due to abrasion in comparison with conventional Ni-Co coatings containing 29% or 42% Co without the addition of any ceramic material. Up to 700° C. for 2 hours, Ni-Co-SiC shows better behaviour than the Ni and Ni-Co coatings with no added ceramic material.

Tests to determine the resistance to wear of composite coatings in accordance with the invention under dry alternating friction conditions were carried out in homogeneous pairings and heterogeneous pairings. The pairings tested were as follows:

Ni-Co-SiC/Ni-Co-SiC (at 400° C.);

Ni-Co-SiC/Z12 C13 (at 20°, 250° and 400° C.); and

Ni-Co-SiC/NC 20 K14 (at 20°, 250° and 400° C.).

Figure 11:
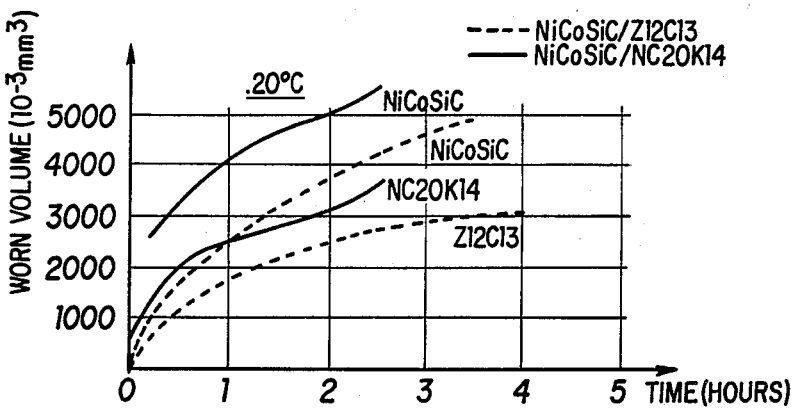
FIGS. 11 to 13 are graphs showing wear curves of a Ni-Co-SiC coating in an homogeneous pairing (identical materials opposite one another) and in heterogeneous pairings (different materials) at 20° C., 250° C. and 400° C. as follows.
Figure 12:
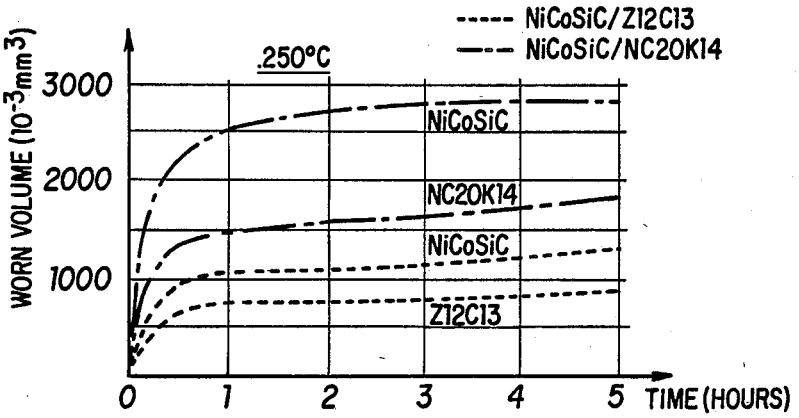
Figure 13:
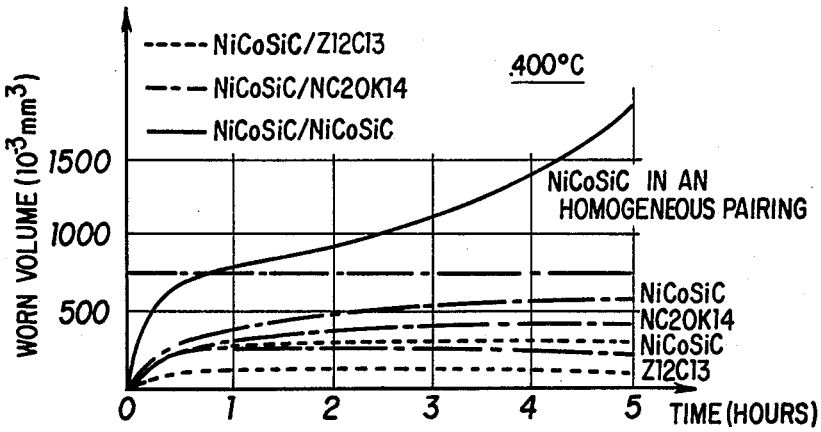

The results are given in FIGS. 11 to 13 and show that although the Ni-Co-SiC coating exhibits average behaviour in homogeneous pairings, the behaviour in heterogeneous pairings is improved by a preliminary surface grinding of the coating.

Similar tests conducted with Ni-Co-$Al_2O_3$ and Ni-Co-$Cr_2O_3$ coatings (although not shown here) show equivalent results but with better resistance to erosion in the case of Ni-Co-$Al_2O_3$ and better resistance to friction in the case of Ni-Co-$Cr_3O_3$.

The type of composite coating in accordance with the invention is of interest because, depending on the opposing material, it makes it possible to obtain a lower friction pairing that those obtainable with other types of protective coatings.

Another advantage it has is that of allowing the use of heterogeneous pairings of materials in friction situations.

These composite protective coatings therefore have considerable advantages and can likewise be useful in terms of sealing tightness at compressor blade tips where the guarantee of minimal clearance is imperative with regard to performance. Fluid tightness is in this case ensured by the abradable material situated on the casing which is partially machinable by the blade opposite it. The composite coatings in accordance with the invention make it possible to ensure blade/abradable material interference without any notable wear of the blade. Indeed, they make it possible to adjust the ductility of the nickel-cobalt matrix and the brittleness/hardness of the abrasive ceramic particles in such a way as to ensure that the blade exerts wear on the abradable material in a ratio of 90:10, so limiting the reduction in engine performance.

In the event of the coatings having undergone an additional stage of electrolytic chromium plating, they will find preferred use in friction parts which are exposed to temperatures equal to or greater than 400° C. in an oxidising atmosphere.

Furthermore, coatings in accordance with the invention, having undergone additional thermal diffusion treatment will see their effective life under friction conditions substantially enhanced.

TABLE 1

Formulations of nickel-cobalt baths (volume 1 liter)

| Bath references | Ni Co | Nickel* Sulphamate ml volume | Nickel* Sulphamate Ni° g/l | Nickel Chloride g/l $NiCl_2$ | Nickel Chloride Ni° g/l | Nickel total g/l | Cobalt** Sulphamate ml volume | Cobalt** Sulphamate Co° g/l | Volume of water q.s./11 | pH of the bath | Volume by mass at 20° C. |
|---|---|---|---|---|---|---|---|---|---|---|---|
| Ni + Co = 75 g/l (2.54 N) | | | | | | | | | | | |
| D | 5 | 364 | 60 | 10 | 2.5 | 62.5 | 71.4 | 12.5 | 565 | 3.9 ± 0.2 | 1.240 |
| C | 15 | 411 | 67.8 | " | " | 70.3 | 28.4 | 4.7 | 561 | 3.9 ± 0.2 | 1.242 |
| E | 20 | 418 | 69 | " | " | 71.5 | 20.3 | 3.6 | 562 | 3.9 ± 0.2 | 1.247 |
| Ni + Co = 87.5 g/l (2.96 N) | | | | | | | | | | | |
| H | 5 | 427 | 70.4 | 10 | 2.5 | 72.9 | 83.4 | 14.6 | 490 | 3.9 ± 0.2 | 1,291 |
| G | 15 | 482 | 79.5 | " | " | 82.00 | 31.2 | 5.4 | 487 | 4.0 ± 0.2 | 1,282 |
| F | 20 | 490 | 80.8 | " | " | 83.3 | 23.8 | 4.2 | 436 | 3.9 ± 0.2 | 1.282 |
| Ni + Co = 100 g/l (3.39 N) | | | | | | | | | | | |
| K | 5 | 492 | 81.2 | 10 | 2.5 | 83.7 | 95.4 | 16.7 | 412 | 3.9 ± 0.2 | 1.315 |
| J | 15 | 553 | 91.2 | " | " | 93.7 | 35.7 | 6.26 | 411 | 4.0 ± 0.2 | 1.305 |
| I | 20 | 562 | 92.8 | " | " | 95.3 | 27.1 | 4.75 | 411 | 3.9 ± 0.2 | 1.307 |

- addition of 40 g/l boric acid + 40 mg/l lauryl sodium sulphate (wetting agent)

*nickel sulphamate solution containing 165 g metallic nickel/l or 1 g metallic nickel = /6.06 ml $(NiNH_2SO_3)_24H_2O$

**cobalt sulphamate solution containing 175 g metallic cobalt/l or 1 g metallic cobalt = 571 ml $(CoNH_2SO_3)_24H_2O$

TABLE 2

Results of TABER abrasion tests on NiCoSiC

| Treatments Thermal/air | Fluctuation in mass mg/4000 cycles | TABER wear index | Abraded volume (mm3) |
|---|---|---|---|
| none | 8 | 2 | 0.9 |
| 2 hrs. 400° C. | 8 | 2 | 0.9 |
| 2 hrs. 500° C. | 8 | 2 | 0.9 |
| 2 hrs. 600° C. | 9 | 2.25 | 1 |
| 100 hrs. 600° C. | 14 | 3.5 | 1.6 |
| 2 hrs. 700° C. | 12 | 3 | 1.4 |

We claim:

1. A method of protecting an alloyed steel or nickel-based superalloy substrate against oxidation and frictional wear at temperatures below 600° C., comprising the steps of:

providing a sulfamate bath having a Ni and Co metallic salts content of from 70 g/l to 100 g/l and a Ni/Co mass ratio of from 5 to 33, said bath containing from 50 g/l to 300 g/l of ceramic particles in suspension, said ceramic particles being selected from the group consisting of SiC, $Al_2O_3$ and $Cr_2O_3$; and subjecting said substrate to electrolysis in said sulfamate bath to provide said substrate with a protective coating by electrolytic codeposition of a binary nickel-cobalt matrix including an homogeneous dispersion of said ceramic particles wherein the content of said ceramic particles in said coating is from 3.5% to 10% by mass.

2. A method according to claim 1, wherein the Ni/Co mass ratio in said bath is 15.

3. A method according to claim 1, wherein the total concentration of said Ni and Co metallic salts in said bath is equal to 87.5 g/l.

4. A method according to claim 1, wherein the mass content of said ceramic particles in suspension in said bath is from 70 g/l to 150 g/l.

5. A method according to claim 1, wherein the granulometry of said ceramic particles in suspension in said bath is from 1 to 5 micrometers.

6. A method according to claim 1, including the step of subjecting said ceramic particles to a decontamination process comprising acid washing in a hydrochloric medium before introducing said ceramic particles into said sulfamate bath.

7. A method according to claim 1, wherein said electrolytic codeposition step is carried out at a current density between 2.5 and 15 A/dm$^2$, a temperature between 50° and 54° C., and a pH between 3.5 and 4.5.

8. A method according to claim 7, wherein said electrolytic codeposition step is carried out with anodes formed by nickel balls disposed in titanium baskets.

9. A method according to claim 7, wherein said electrolytic codeposition step includes the steps of agitating said sulfamate bath by the combined means of a turbine disperser and compressed air, and simultaneously causing the cathode to perform an "up and down" movement.

10. A method according to claim 9, wherein said turbine disperser is rotated about a vertical axis at from 1750 to 2250 rpm, said pressurized air is introduced at the bottom of said bath, and said cathode is moved up and down on a vertically reciprocable arm between said disperser and the inlet of said pressurized air, said substrate being disposed on said arm and subjected to the cathodic voltage.

11. A method according to claim 7, including the further step of subjecting the coated substrate to a subsequent electrolytic chromium plating stage to produce a plating thickness of from 2 to 10 micrometers on the protective coating.

12. A method according to claim 7, wherein said ceramic particles are of SiC, and said electrolytic codeposition step is carried out at a current density of 5 A/dm$^2$, a temperature of 52° C., and a pH of 4.

13. A method according to claim 12, including the further step of subjecting the coated substrate to a subsequent heat treatment process under a neutral gas for a period of from 1 hour to 3 hours and at a temperature of from 550° C. to 620° C. in order to diffuse the silicon in the coating matrix.

14. A substrate having a protective coating obtained by a method according to claim 12, wherein said coating has the following composition by weight: Ni=63±2%; Co=30±2%; SiC=4±2%.

15. A method according to claim 7, wherein said ceramic particles are of $Al_2O_3$, and said electrolytic codeposition step is carried out at a current density of 5 A/dm$^2$, a temperature of 52° C., and a pH of 4.

16. A substrate having a protective coating obtained by a method according to claim 15, wherein said coating has the following composition by weight: Ni=63±3%; Co=32±2%; $Al_2O_3$=4.5±0.5%.

17. A method according to claim 7, wherein said ceramic particles are of $Cr_2O_3$, and said electrolytic codeposition step is carried out at a current density of 3 A/dm$^2$, a temperature of 52° C., and a pH of 4.

18. A substrate having a protective coating obtained by a method according to claim 17, wherein said coating has the following composition by weight: Ni=58±3%; Co=33$^3$±3%; $Cr_2O_3$=9±1%.

* * * * *

UNITED STATES PATENT AND TRADEMARK OFFICE

CERTIFICATE OF CORRECTION

PATENT NO. : 4,886,583

DATED : December 12, 1989

INVENTOR(S) : Martinou et al

It is certified that error appears in the above-identified patent and that said Letters Patent is hereby corrected as shown below:

TITLE Page: Bibliographic data section [57] Abstract, line 4, "electrolyte" should read --electrolytic--

Column 3, line 11, change "micrograph" to

--microphotograph--

Column 7, line 64, change "oxidised" to

--oxidized--

Column 8, line 6, change "summarised" to

--summarized-- line 33, change "Ni-Co-$Cr_3O_3$" to

--Ni-Co-$Cr_2O_3$-- line 37, change "pairing that" to

--pairing than-- line 64, change "oxidising" to

--oxidizing--

UNITED STATES PATENT AND TRADEMARK OFFICE

CERTIFICATE OF CORRECTION

PATENT NO. : 4,886,583

DATED : December 12, 1989

INVENTOR(S) : Martinou et al

It is certified that error appears in the above-identified patent and that said Letters Patent is hereby corrected as shown below:

Column 10, Table 1, line 13, change "1,291" to

--1.291--

Table 1, line 14, change "1,282" to

--1.282--

Column 12, line 6, change "Co=33$^3$±3%" to

--Co=33±3%--

Signed and Sealed this

Second Day of July, 1991

*Attest:*

HARRY F. MANBECK, JR.

*Attesting Officer*

*Commissioner of Patents and Trademarks*